US007464937B1

(12) United States Patent
Maggio

(10) Patent No.: US 7,464,937 B1
(45) Date of Patent: Dec. 16, 2008

(54) WATER SPORT TARGET GAME

(76) Inventor: Salvatore Maggio, 15055 Harvest Meadows Dr., Sterling Heights, MI (US) 48313

( * ) Notice: Subject to any disclaimer, the term of this patent is extended or adjusted under 35 U.S.C. 154(b) by 0 days.

(21) Appl. No.: 11/724,340

(22) Filed: Mar. 15, 2007

(51) Int. Cl.
*A63B 63/04* (2006.01)

(52) U.S. Cl. ..... 273/350; 273/390

(58) Field of Classification Search ..... 273/348, 273/348.4, 348.5, 349, 350, 390–392, 407
See application file for complete search history.

(56) References Cited

U.S. PATENT DOCUMENTS

| | | | | |
|---|---|---|---|---|
| 3,134,594 | A | 5/1964 | Crowley | |
| 3,403,907 | A | 10/1968 | Keller | |
| 3,652,090 | A * | 3/1972 | Semmens | 273/336 |
| 3,656,749 | A | 4/1972 | Reyes | |
| 3,888,488 | A * | 6/1975 | Sims | 273/260 |
| 4,116,443 | A * | 9/1978 | Dorfman | 273/388 |
| 4,223,894 | A * | 9/1980 | Fabricant | 273/349 |
| 4,266,780 | A * | 5/1981 | McQuary | 273/387 |
| D264,740 | S | 6/1982 | Merino et al. | |
| 5,318,307 | A * | 6/1994 | Bouchard et al. | 273/348.4 |
| 5,358,742 | A * | 10/1994 | Ziff | 427/276 |
| 5,417,434 | A * | 5/1995 | Romero | 273/350 |
| 5,421,585 | A | 6/1995 | Ruvio | |
| 5,584,768 | A * | 12/1996 | Lee | 473/190 |
| D378,687 | S | 4/1997 | Clark et al. | |
| 5,632,490 | A * | 5/1997 | Brown | 273/350 |
| 5,657,995 | A * | 8/1997 | Howard | 273/333 |
| D388,127 | S | 12/1997 | Cavallone, Sr. | |
| 6,089,570 | A | 7/2000 | Gruber | |
| 6,173,957 | B1 | 1/2001 | James, Sr. | |
| 6,520,874 | B2 | 2/2003 | Beazley | |
| 6,959,926 | B2 * | 11/2005 | Melchiorri | 273/287 |
| 7,210,685 | B2 * | 5/2007 | Cheng | 273/348.4 |

* cited by examiner

*Primary Examiner*—Mark S Graham

(57) ABSTRACT

The invention consists of a raft with a plurality of cutouts to accommodate the targets. The float maintains stability with the use of a weight that is submerged under the water and is connected to the float by a string. There are three embodiments regarding the targets geometry and interaction with the float and water. One third embodiment employs a sphere mounted on a spring loaded coil, in which the target may be impacted by the throwing ball from any angle. A variety of point-scoring systems could be implemented as well as the number of players who would play the game.

1 Claim, 7 Drawing Sheets

WATER SPORT TARGET GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present field of the invention relates to a target game that is played in and around a body of water.

B. Discussion of the Prior Art

The Crowley patent (U.S. Pat. No. 3,134,594) discloses a game with a floating goal area that includes two baskets which a user must throw their ball into. This patent involves a basketball-like sport, as opposed to a football-like target game.

The Gruber patent (U.S. Pat. No. 6,089,570) discloses a ball and target game which is adapted to float on water and uses a point system for determining the outcome as well as a nylon hook and loop attachment means between the target and throwing ball. This patent does not utilize a floating target board in which the target's are spring-loaded and recoil back to the up position.

The James, Sr. patent (U.S. Pat. No. 6,173,957) discloses a tossing game that uses a point scoring method and comprising multiple inflatable ring targets. This patent utilizes inflatable ring targets in which the user must throw the ball through, as opposed to a spring-loaded target that is square in shape.

The Reyes patent (U.S. Pat. No. 3,656,749) discloses a game target with floatation means upon which a projectile, such as a ball, may be received. This patent resembles a basketball-like shooting game as opposed to a football-like target throwing game.

The Ruvio patent (U.S. Pat. No. 5,421,585) discloses a floating water game that utilizes a point scoring system and multiple game targets. This patent applies to a ring tossing-like game, as opposed to a football-like target throwing game.

The Keller patent (U.S. Pat. No. 3,403,907) discloses a water game comprising a floating game target and throwing projectiles. This patent is directed to a disc tossing game where the target rests on a float in a body of water, but does not involve a spring-loaded target that utilizes a football-like throwing means.

The Beazley patent (U.S. Pat. No. 6,520,874) discloses a game for use in swimming pools which includes a floating goal area where a player must throw a ball through a hole. However, this patent does not utilize a spring-loaded target that rests on a floating board in a body of water.

The Merino et al. patent (U.S. Pat. No. Des. 264,740) illustrates a design for a water basketball game goal.

The Cavallone, Sr. patent (U.S. Pat. No. Des. 388,127) illustrates a design for a skill game target that does not involve floating spring-loaded targets or even water.

The Clark et al. patent (U.S. Pat. No. Des. 378,687) illustrates a design for a toss game target that does not involve floating spring-loaded targets or even water.

BRIEF SUMMARY OF THE INVENTION

The invention consists of a raft with a plurality of cutouts to accommodate the targets. The float maintains stability with the use of a weight that is submerged under the water and is connected to the float by a string. There are three embodiments regarding the targets geometry and interaction with the float and water. The first embodiment involves a target that has a height that is half the length of the opening in the float, and is spring loaded in such a manner that the target may rotate forward or backward when struck by a ball. The second embodiment involves a target that has a height that is equal to the length of the opening in the float, and is not spring loaded at its connection point to the float. Instead, the half of the target rests submerged under water, and the other half of the target rests in the air. When a ball strikes the target, the target can rotate in 360 degrees. The end user throws a ball of some sort from a distance, either out of the water or in the water, at the target. The third embodiment employs a sphere mounted on a spring loaded coil, in which the target may be impacted by the throwing ball from any angle. A variety of point-scoring systems could be implemented as well as the number of players who would play the game.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1A:
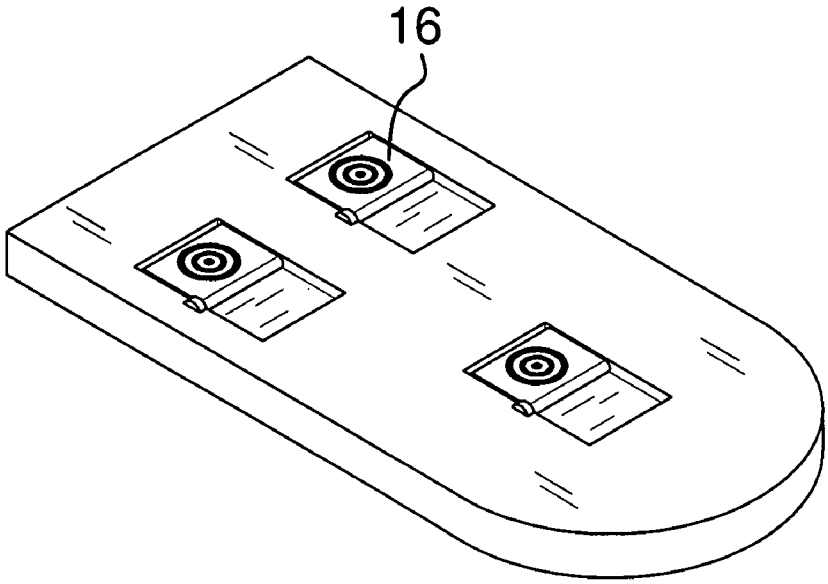
FIG. 1A illustrates an isometric view of the invention with the first embodiment of the targets in the down position.
Figure 1B:
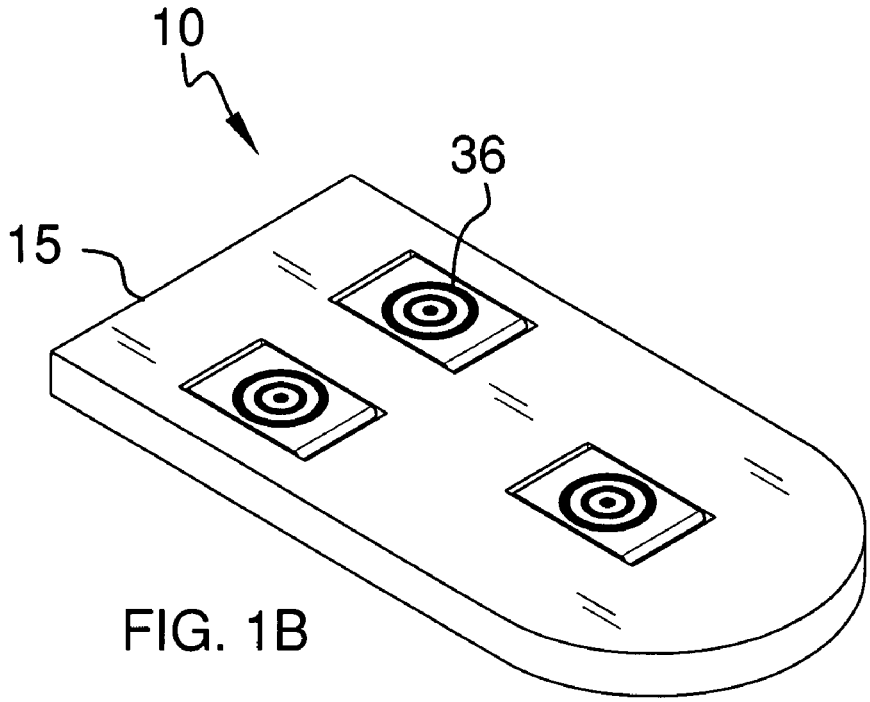
FIG. 1B illustrates an isometric view of the invention with the second embodiment of the targets in the down position.
Figure 2A:
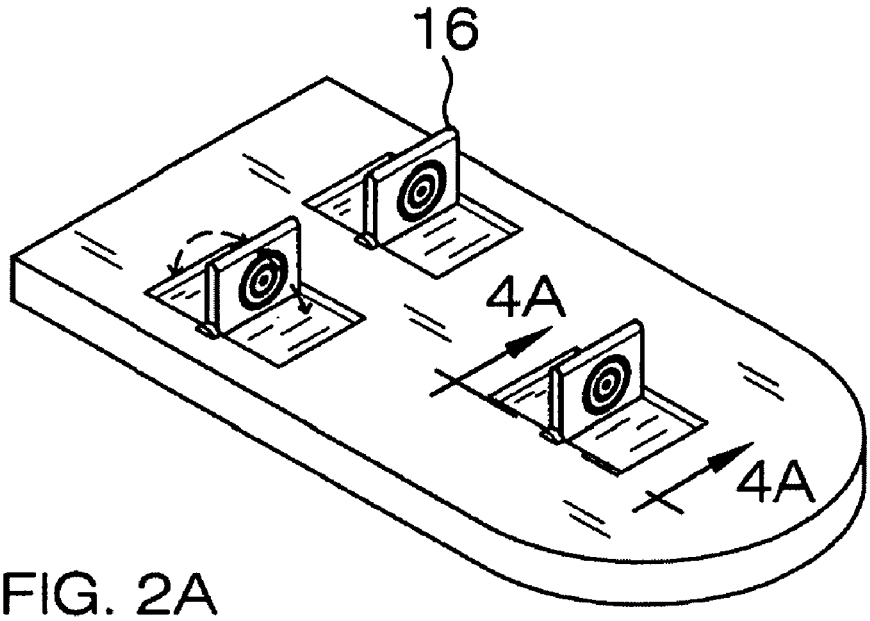
FIG. 2A illustrates an isometric view of the invention with the first embodiment of the targets in the up position.
Figure 2B:
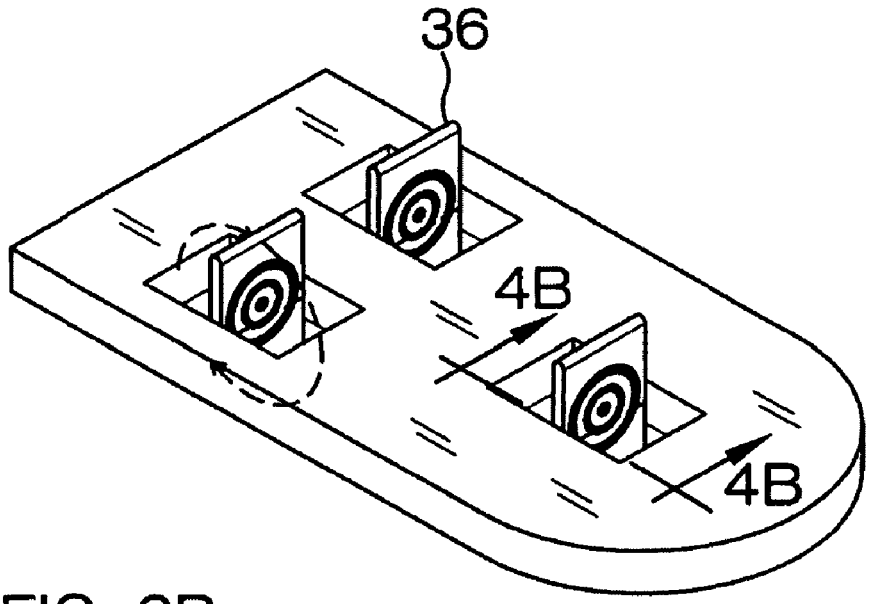
FIG. 2B illustrates an isometric view of the invention with the second embodiment of the targets in the up position.
Figure 3A:
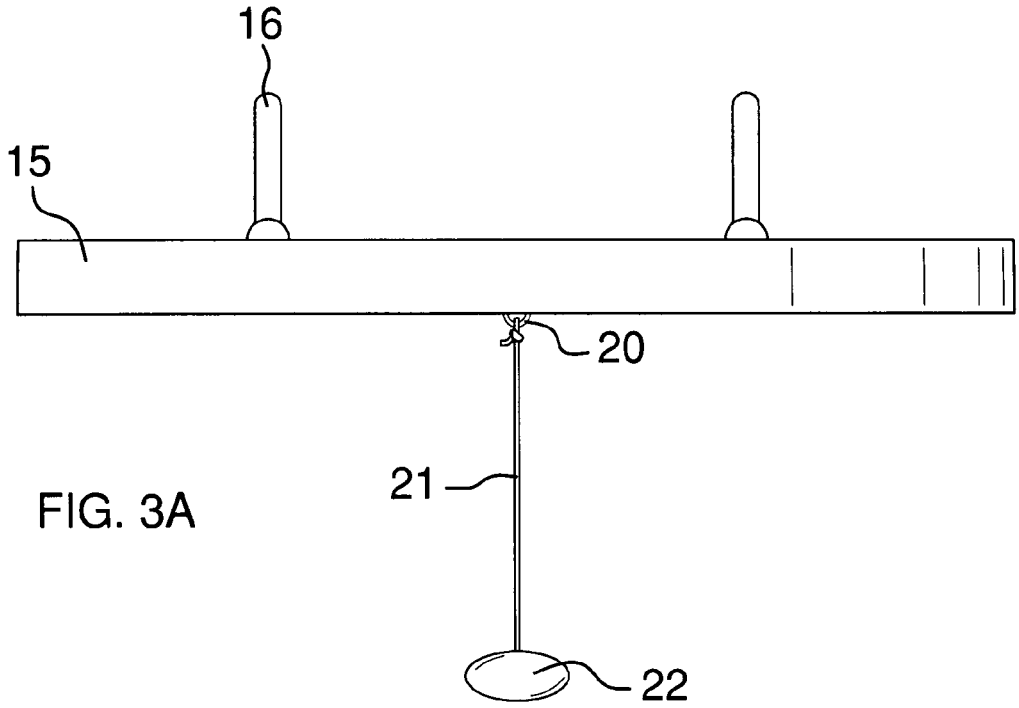
FIG. 3A illustrates a side view of the invention with the first embodiment of the targets in the up position.
Figure 3B:
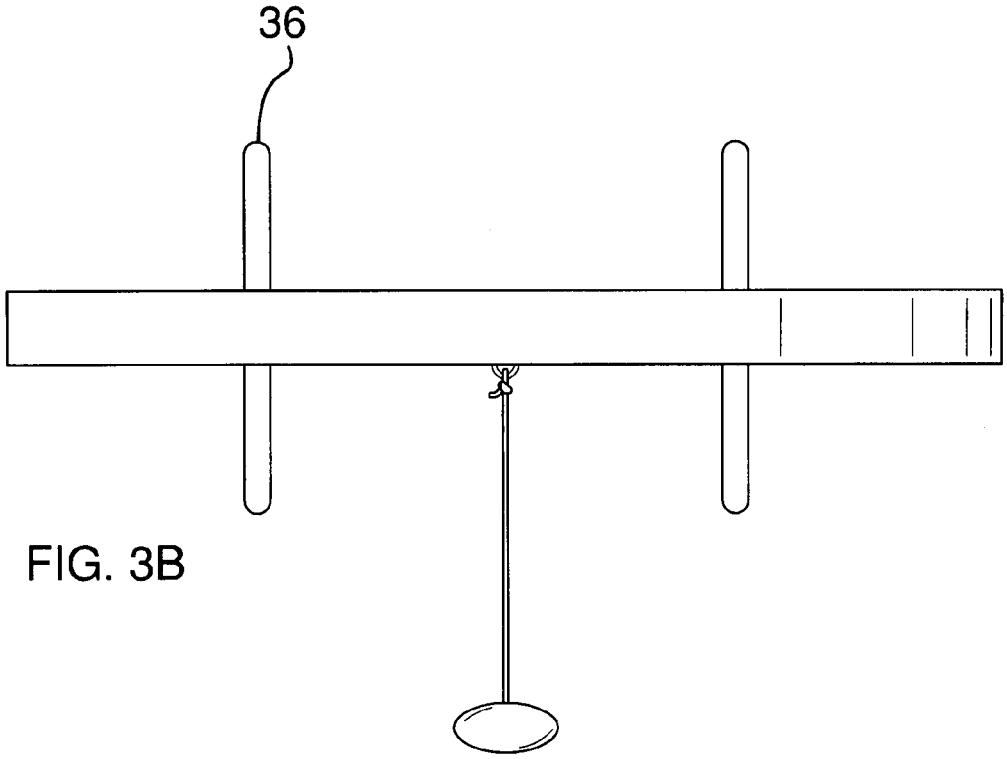
FIG. 3B illustrates a side view of the invention with the second embodiment of the targets in the up position.
Figure 4A:
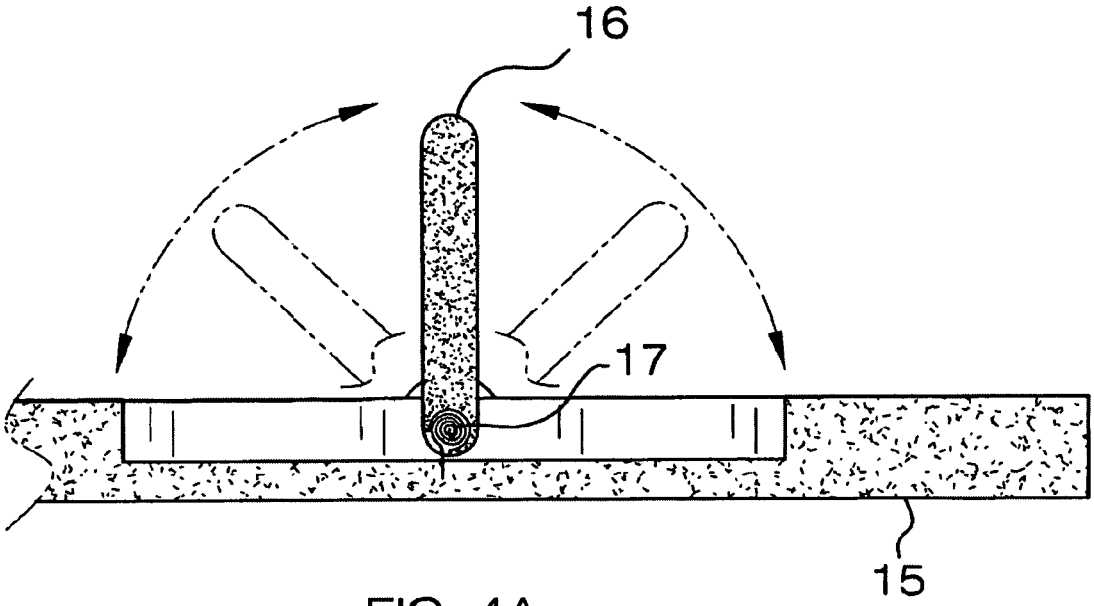
FIG. 4A illustrates a cross-sectional view of the first embodiment of the targets along line 4A-4A.
Figure 4B:
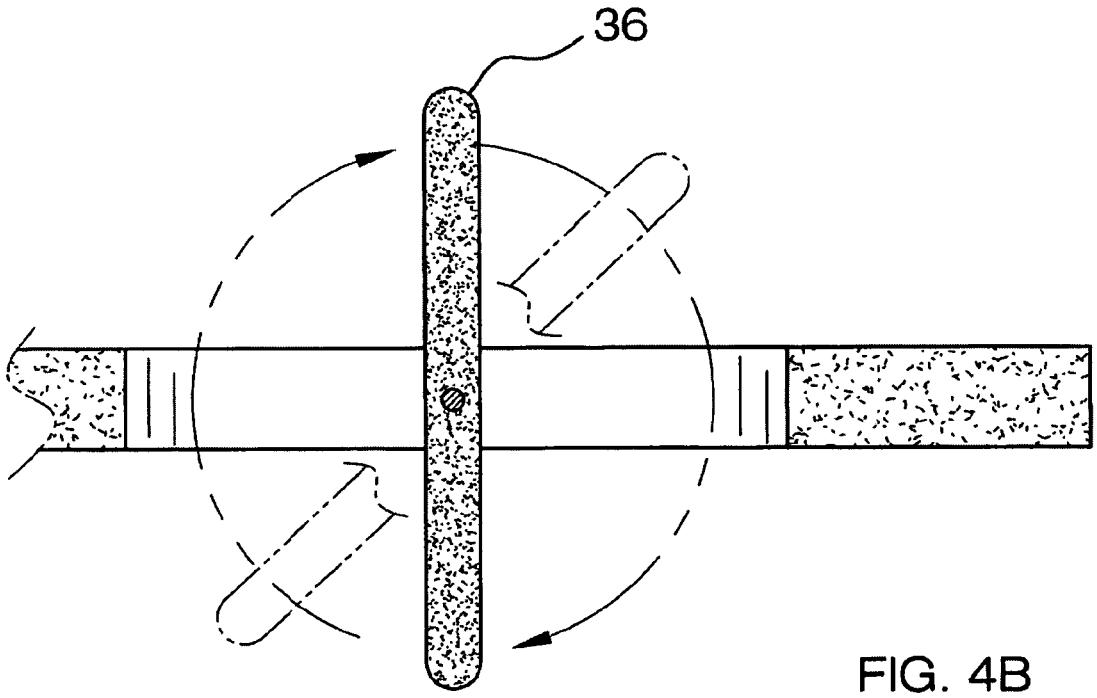
FIG. 4B illustrates a cross-sectional view of the second embodiment of the targets along line 4B-4B.
Figure 5:
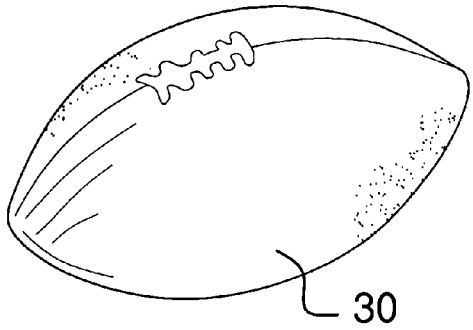
FIG. 5 illustrates an example of a targeting ball.
Figure 6A:
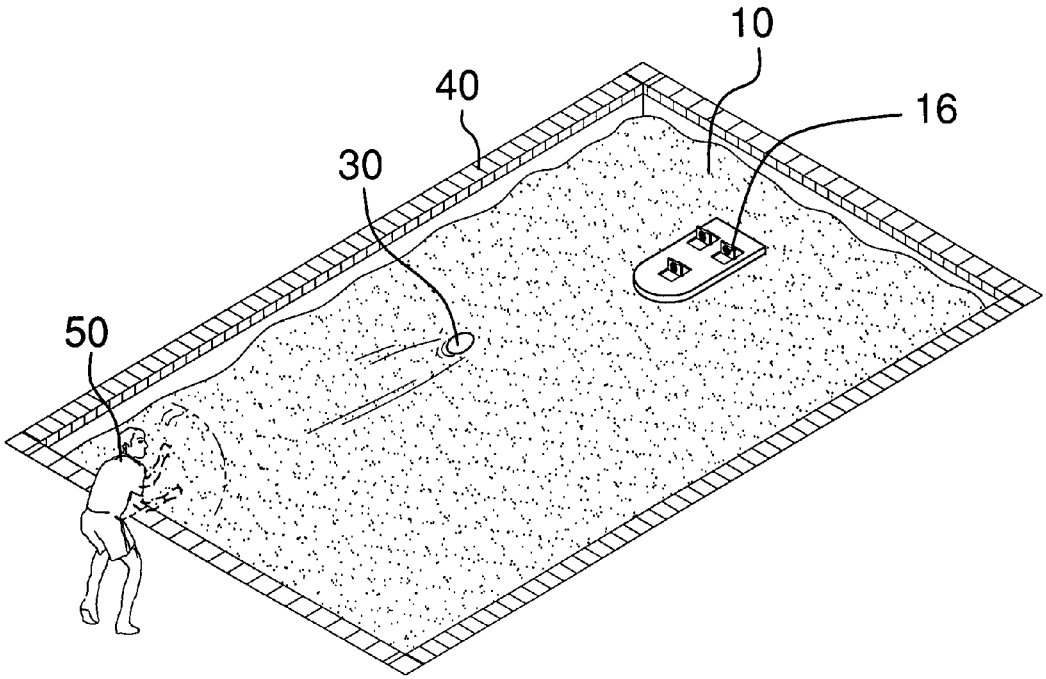
FIG. 6A illustrates the invention with the first embodiment of the targets in use.
Figure 6B:
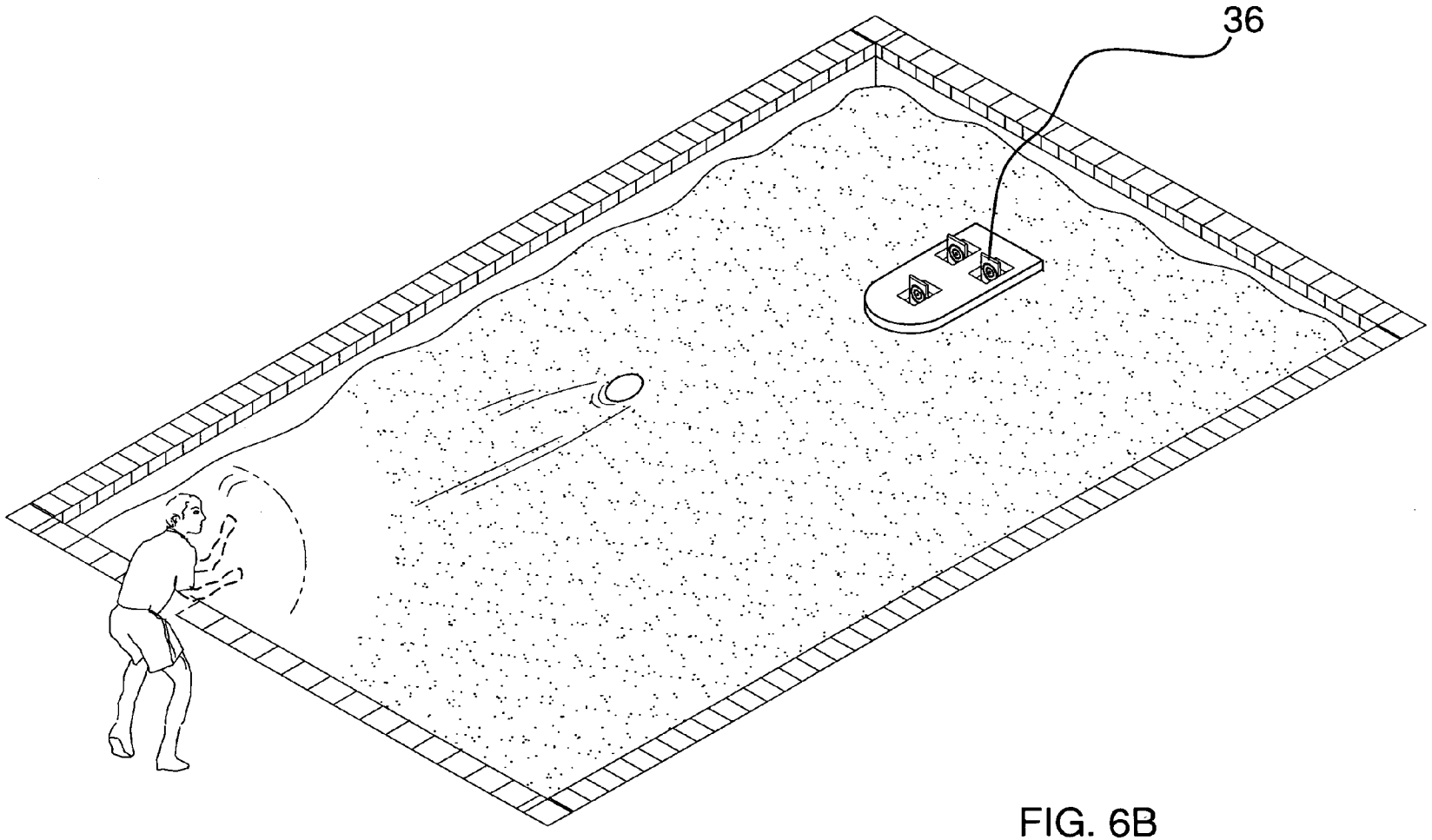
FIG. 6B illustrates the invention with the second embodiment of the targets in use.

Detailed reference will now be made to the first embodiment of the present invention, examples of which are illustrated in FIGS. 1A, 2A, 3A, 4A, and 6A.

An invention 10 comprises a float 15, which has cutouts to supply a plurality of targets 16. The targets 16 connect to the float 15 by a spring 17. The spring 17 has a natural bias, which places the target 16 in the upright position. Once a target 16 is impacted by a targeting ball 30, the target 16 will rotate to down and return back to the up-right position by the spring 17. The target 16 can only be impacted by the targeting ball 30 from one of two sides, which is a limiting factor of this embodiment.

A variation of the first embodiment containing the target 16 is to have a locking mechanism (not shown), which activates when the target 16 is struck by the targeting ball 30 causing the target 16 to rotate either forward or backward at which point the target 16 will lock in a predetermined position. By providing the locking mechanism (not shown) the target 16 will lock into a predetermined position such that the target 16 can no longer be impacted and counted for the score. Instead the target 16 must be unlocked from the locking mechanism (not shown) once all of the remaining targets are hit, and the game requires the targets 16 to be reset to the upright position.

Detailed reference will now be made to the second embodiment of the present invention, examples of which are illustrated in FIGS. 1B, 2B, 3B, 4B, and 6B. A plurality of targets 36 connect to the float 15 and can rotate 360 degrees about their point of connection to the float 15. The targets 36 extend both upwardly and downwardly when at rest, so that half of the target 36 is up in the air in a vertical position for impact by the targeting ball 30 when at rest. When impacted by the targeting ball 30, the target 36 spins about the connection point before resting. The shape of the target 36 causes it to stay vertical when at rest.

A variation of the second embodiment would be to employ a locking mechanism (not shown) to each of the targets 36. The locking mechanism (not shown) would lock the target 36 to a horizontal position with respect to the float 15 when the target 36 is impacted by the targeting ball 30. The idea being that once the target 36 is impacted and locked in a down position, the target 36 can no longer be impacted by the targeting ball 36 and no more points scored. If the target 36 is impacted by the targeting ball 30, and the target 36 is locked in a locking position by the locking mechanism (not shown), the target 36 must be unlocked by the end user for the target 36 to return to a vertical position.

Figure 7:
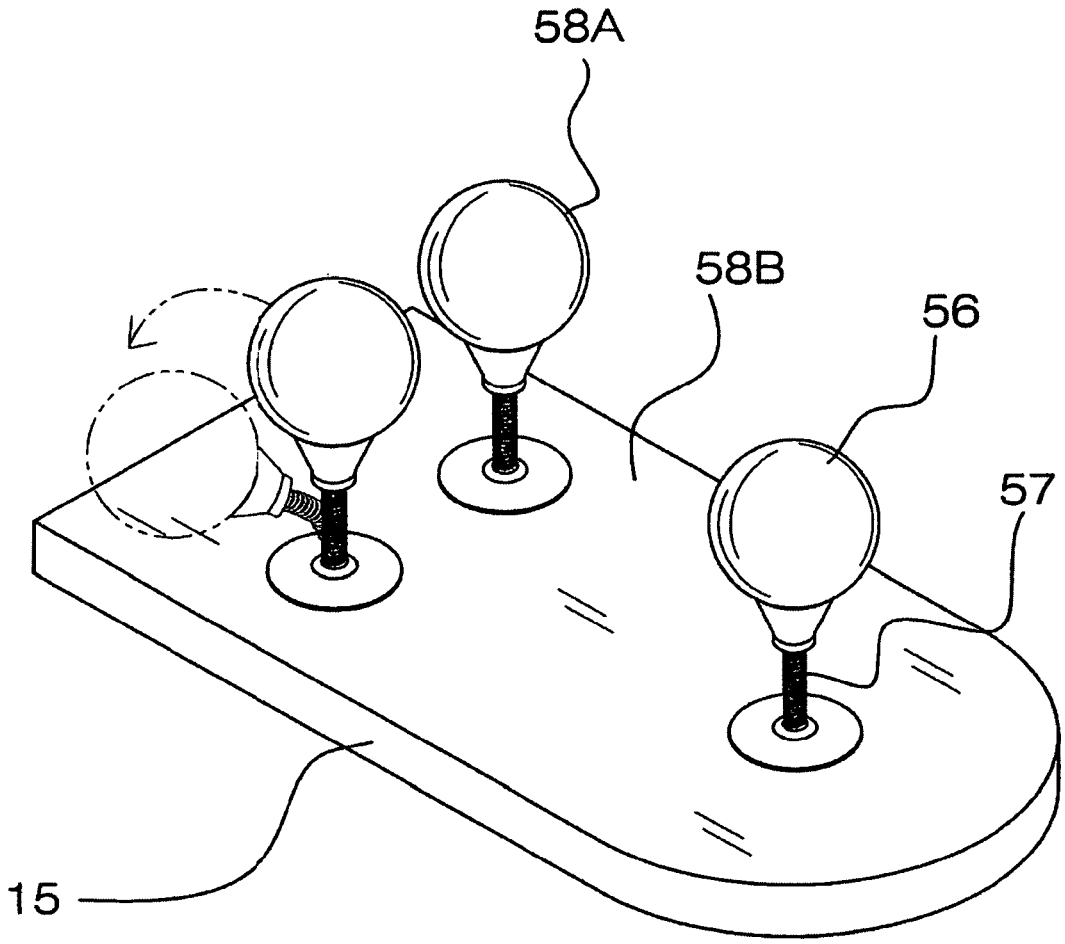
FIG. 7 illustrates the invention with the third embodiment of the target in use.

Detailed reference will now be made to the third embodiment of the present invention, examples of which are illustrated in FIG. 7. A plurality of targets 56 connects to the float 15 by a respective plurality of spring-loaded coils 57 that are mounted to both the surface of the float 15 and the target 56. The spring-loaded coil 57 enables the target 56 to be impacted by the targeting ball 30 and rotate in any direction with respect to the float 15. The third embodiment provides the most flexibility when compared to the other embodiments, in that it enables the target 56 to be impacted from any direction as opposed to a front and rear side.

A variation of the third embodiment would require the target 56 to be covered in a nylon loop material (not shown), and the top surface of the float to be covered in a nylon hook material (not shown). The result being that the addition of the nylon loop and hook material will cause the target 56 to stick to the top surface of the float 15 when impacted by the targeting ball 30. If one of the targets 56 is impacted by the targeting ball 30, and sticks to the top side of the float 15, the target 56 will not return to the upright position until the end user manually separates the nylon loop and hook materials from one another.

Connected to the underside of the float is a hook 20. A weight 22 connects to the float 15 by a string 21 that is tied to the hook 20. The weight 22 provides stability to the float 15 in order to prevent the float 15 from capsizing.

The invention 10 is placed into a body of water, such as a pool 40. The invention is played by throwing the targeting ball 30 by a game player 50 from either in the water or out of the water.

The game format is expandable in terms of the number of game players 50 as well as the point-scoring system. The game format might score more points for the targets that are furthest away as opposed to the targets that are closer to the game player 50.

While the embodiments of the invention have been disclosed, certain modifications may be made by those skilled in the art to modify the invention without departing from the spirit of the invention.

The inventor claims:

1. A water sport target game comprising:

(a) a float;

(b) a plurality of targets;

wherein each target consists of a ball mounted to a spring-loaded coil, which is mounted to the top surface of the float;

wherein the target rests in an up-right position due to the spring-loaded coil until it is impacted by a targeting ball;

wherein the surface of each target is covered in a nylon loop material;

(c) a hook is mounted to the underside of the float;

wherein a string is tied at one end to the hook and at the other end of the string is attached a weight, which provides stability for the float; and wherein the top surface of the float is covered in a nylon hook material such that when the target is impacted and rotates via the spring-loaded coil to a point of which the surface of the target impacts the top surface of the float, the target will stick to the surface of the float and thereafter remain via the adhesion generated between the surfaces of the nylon loop and hook materials.

* * * * *